US008698410B2

(12) United States Patent
Gao et al.

(10) Patent No.: US 8,698,410 B2
(45) Date of Patent: Apr. 15, 2014

(54) LED BACKLIGHT DRIVING CIRCUIT

(75) Inventors: Xinming Gao, Shenzhen (CN); Xiang Yang, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 196 days.

(21) Appl. No.: 13/380,072

(22) PCT Filed: Oct. 18, 2011

(86) PCT No.: PCT/CN2011/080945

§ 371 (c)(1),
(2), (4) Date: Dec. 22, 2011

(87) PCT Pub. No.: WO2013/004061

PCT Pub. Date: Jan. 10, 2013

(65) Prior Publication Data

US 2013/0002162 A1 Jan. 3, 2013

(30) Foreign Application Priority Data

Jul. 1, 2011 (CN) ..... 2011 1 0184078

(51) Int. Cl.
*H05B 37/02* (2006.01)

(52) U.S. Cl.
USPC ..... 315/210; 315/291

(58) Field of Classification Search
None
See application file for complete search history.

(56) References Cited

U.S. PATENT DOCUMENTS

| | | | | |
|---|---|---|---|---|
| 5,959,438 | A * | 9/1999 | Jovanovic et al. | 323/222 |
| 6,614,131 | B2 * | 9/2003 | Lentini et al. | 307/39 |
| 7,071,582 | B2 * | 7/2006 | Sae-Ueng et al. | 307/83 |
| 7,825,612 | B2 * | 11/2010 | Lee | 315/308 |
| 8,183,795 | B2 * | 5/2012 | Huang et al. | 315/294 |
| 2006/0022649 | A1 * | 2/2006 | Lee et al. | 323/225 |

FOREIGN PATENT DOCUMENTS

| | | | |
|---|---|---|---|
| CN | 1949946 | A | 4/2007 |
| CN | 101313632 | A | 11/2008 |
| CN | 101923841 | A | 12/2010 |

OTHER PUBLICATIONS

International Search Report of the PCT Application No. PCT/CN2011/080945.

1st Office Action of Chinese Patent Application No. 201110184078.X issued by Chinese Patent Office.

* cited by examiner

*Primary Examiner* — Crystal L Hammond

(57) ABSTRACT

A light emitting diode (LED) backlight driving circuit is disclosed in the present disclosure. The LED backlight driving circuit in configured to power an LED backlight module, and comprises: a voltage stabilizing circuit, being configured to receive an input voltage and filter the input voltage to output a stabilized direct current (DC) voltage; a first boost circuit and a second boost circuit connected with the voltage stabilizing circuit respectively, being configured to receive the stabilized DC voltage and boost the stabilized DC voltage for output to the LED backlight module; and a selection control circuit, being configured to alternately select one of the first boost circuit and the second boost circuit to power the LED backlight module. The LED backlight driving circuit of the present disclosure can improve the voltage boosting efficiency and reduce the cost, so it is of great utility.

16 Claims, 3 Drawing Sheets

LED BACKLIGHT DRIVING CIRCUIT

BACKGROUND

1. Technical Field

The present disclosure relates to the technical field of light emitting diode (LED) driving circuits, and more particularly, to an LED backlight driving circuit.

2. Description of Related Art

In the prior art LED backlight driving circuits, a boost circuit (i.e., a boost converter or step-up converter) is usually used to power an LED.

Referring to FIG. 1, the boost circuit comprises a first inductor L0, a second inductor L, a diode D, a first capacitor C0, a second capacitor C, a metal-oxide-semiconductor field-effect transistor (MOSFET) Q and a resistor R. Herein, the MOSFET is simply called MOS transistor. The first inductor L0, the second inductor L, the diode D and the first capacitor C0 are connected in series with each other in sequence and then connected in parallel with the second capacitor C. A branch formed by the MOS transistor Q connected in series with the resistor R has one end connected between the first inductor L0 and the second inductor L, and the other end connected between the first capacitor C0 and the second capacitor C. In the boost circuit, an input voltage is filtered by the second capacitor C to obtain a stabilized direct current (DC) voltage, and a voltage across the first capacitor C0 is boosted by the first inductor L0 and the second inductor L; and a square wave driving circuit is used to control the MOS transistor Q so that a voltage can be supplied to the LED by the first capacitor C0 when the MOS transistor Q is turned on.

However, when the load becomes greater as the number of LEDs increases, a plurality of boost circuits must be used instead of the single boost circuit to power the LEDs, which adds to the cost.

BRIEF SUMMARY

The primary objective of the present disclosure is to provide an LED backlight driving circuit which can improve the voltage boosting efficiency and reduce the cost.

The present disclosure provides an LED backlight driving circuit for powering an LED backlight module, which comprises:

a voltage stabilizing circuit, being configured to receive an input voltage and filter the input voltage to output a stabilized direct current (DC) voltage;

a first boost circuit and a second boost circuit connected with the voltage stabilizing circuit respectively, being configured to receive the stabilized DC voltage and boost the stabilized DC voltage for output to the LED backlight module; and a selection control circuit, being configured to alternately select one of the first boost circuit and the second boost circuit to power the LED backlight module.

Preferably, the first boost circuit comprises:

a first inductor L1, a second inductor L2 and a diode D2 connected in series in sequence, and a metal-oxide-semiconductor field-effect transistor (MOS transistor) Q2 whose drain is connected between the first inductor L1 and the second inductor L2, wherein the MOS transistor Q2 has a gate connected to the selection control circuit and a source connected to the ground, and the MOS transistor Q2 is a P-channel MOS transistor; and the second boost circuit comprises:

a first inductor L3, a second inductor L4 and a diode D1 connected in series in sequence, and an MOS transistor Q1 whose drain is connected between the first inductor L3 and the second inductor L4, wherein the MOS transistor Q1 has a gate connected to the selection control circuit and a source connected to the ground, and the MOS transistor Q1 is an N-channel MOS transistor.

Preferably, the selection control circuit comprises:

a push-pull circuit connected to the MOS transistor Q1 and the MOS transistor Q2 respectively, being configured to turn on the MOS transistor Q1 or the MOS transistor Q2;

a DC-blocking circuit connected to the push-pull circuit, being configured to supply a DC-blocked voltage to the push-pull circuit; and a pulse width modulation (PWM) chip connected to the DC-blocking circuit, being configured to control, through the DC-blocking circuit and the push-pull circuit, the MOS transistor Q1 and the MOS transistor Q2 to turn on alternately.

Preferably, the push-pull circuit comprises:

a first transistor Q3 and a second transistor Q4, wherein an emitter of the first transistor Q3 is connected with an emitter of the second transistor Q4, a base of the first transistor Q3 is connected in parallel with a base of the second transistor Q4 to the DC-blocking circuit, a collector of the first transistor Q3 is connected to a power source, a collector of the second transistor Q4 is connected to the ground, the first transistor Q3 is of a PNP type, and the second transistor Q4 is of an NPN type.

Preferably, the DC-blocking circuit is a DC-blocking capacitor C1.

Preferably, the PWM chip is further configured to control an output voltage to be at a constant level by sampling the output voltage, comparing the sampled output voltage with a reference voltage and adjusting turn-on time periods of the first boost circuit and the second boost circuit according to the comparison result.

Preferably, the voltage stabilizing circuit comprises:

two capacitors connected to the first boost circuit and the second boost circuit respectively.

Preferably, the two capacitors have one end thereof connected to the first boost circuit and the second boost circuit respectively, and have the other end thereof connected together to the ground.

The present disclosure further provides an LED backlight driving circuit for powering an LED backlight module, which comprises:

a voltage stabilizing circuit, being configured to receive an input voltage and filter the input voltage to output a stabilized DC voltage;

a first boost circuit and a second boost circuit connected with the voltage stabilizing circuit respectively, being configured to receive the stabilized DC voltage and boost the stabilized DC voltage for output to the LED backlight module, wherein preferably, the first boost circuit comprises: a first inductor L1, a second inductor L2 and a diode D2 connected in series in sequence, and an MOS transistor Q2 whose drain is connected between the first inductor L1 and the second inductor L2, wherein the MOS transistor Q2 has a gate connected to the selection control circuit and a source connected to the ground, and the MOS transistor Q2 is a P-channel MOS transistor; and the second boost circuit comprises: a first inductor L3, a second inductor L4 and a diode D1 connected in series in sequence, and an MOS transistor Q1 whose drain is connected between the first inductor L3 and the second inductor L4, wherein the MOS transistor Q1 has a gate connected to the selection control circuit and a source connected to the ground, and the MOS transistor Q1 is an N-channel MOS transistor; and a selection control circuit, being configured to alternately select one of the first boost circuit and the second boost circuit to power the LED backlight module and sample an output voltage to adjust turn-on time periods of the first boost circuit and the second boost circuit.

Preferably, the selection control circuit comprises:

a push-pull circuit connected to the MOS transistor Q1 and the MOS transistor Q2 respectively, being configured to turn on the MOS transistor Q1 or the MOS transistor Q2;

a DC-blocking circuit connected to the push-pull circuit, being configured to supply a DC-blocked voltage to the push-pull circuit; and a PWM chip connected to the DC-blocking circuit, being configured to control, through the DC-blocking circuit and the push-pull circuit, the MOS transistor Q1 and the MOS transistor Q2 to turn on alternately;

wherein the PWM chip is further configured to control the output voltage to be at a constant level by sampling the output voltage, comparing the sampled output voltage with a reference voltage and adjusting the turn-on time periods of the first boost circuit and the second boost circuit according to the comparison result.

Preferably, the push-pull circuit comprises:

a first transistor Q3 and a second transistor Q4, wherein an emitter of the first transistor Q3 is connected with an emitter of the second transistor Q4, a base of the first transistor Q3 is connected in parallel with a base of the second transistor Q4 to the DC-blocking circuit, a collector of the first transistor Q3 is connected to a power source, a collector of the second transistor Q4 is connected to the ground, the first transistor Q3 is of a PNP type, and the second transistor Q4 is of an NPN type.

Preferably, the DC-blocking circuit is a DC-blocking capacitor C1.

Preferably, the voltage stabilizing circuit comprises:

two capacitors connected to the first boost circuit and the second boost circuit respectively.

Preferably, the two capacitors have one end thereof connected to the first boost circuit and the second boost circuit respectively, and have the other end thereof connected together to the ground.

According to the LED backlight driving circuit of the present disclosure, a first boost circuit and a second boost circuit are disposed to power the LED backlight module alternately, so it is unnecessary to dispose capacitors for outputting stabilized voltages in the first boost circuit and the second boost circuit. This improves the voltage boosting efficiency of the LED backlight driving circuit and reduces the cost without increasing the duty ratio. Therefore, the present disclosure is of great utility.

Hereinafter, implementations, functional features and advantages of the present disclosure will be further described with reference to embodiments thereof and the attached drawings.

DETAILED DESCRIPTION

It shall be understood that, the embodiments described herein are only intended to illustrate but not to limit the present disclosure.

Figure 1:
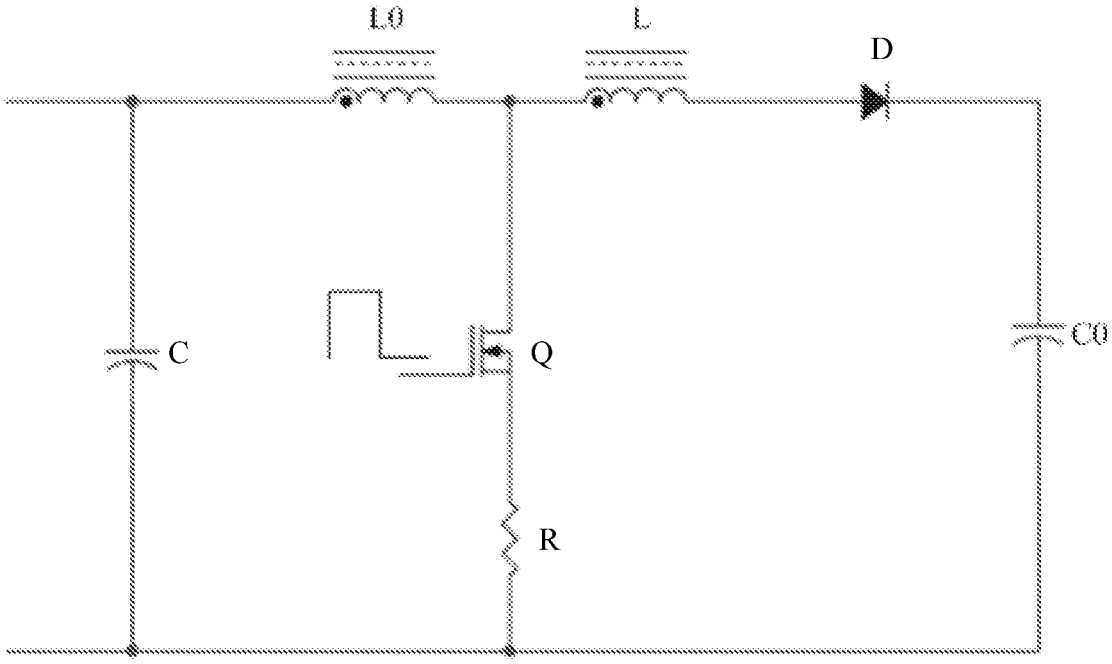
FIG. 1 is a schematic view illustrating a structure of a prior art boost circuit.
Figure 2:
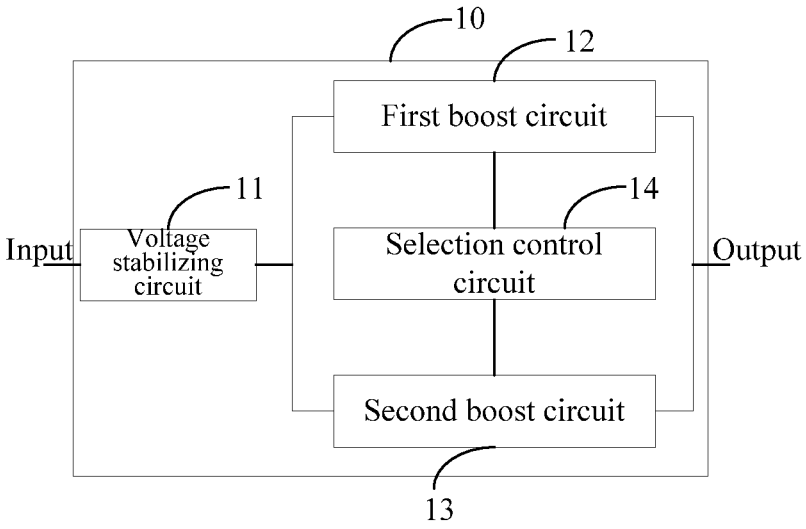
FIG. 2 is a schematic view illustrating an overall structure of an embodiment of an LED backlight driving circuit according to the present disclosure.

Referring to FIG. 2, the present disclosure provides an embodiment of a light emitting diode (LED) backlight driving circuit 10. The LED backlight driving circuit 10 is configured to power an LED backlight module (not shown), and comprises: a voltage stabilizing circuit 11, a first boost circuit 12, a second boost circuit 13 and a selection control circuit 14. The voltage stabilizing circuit 11 is configured to receive an input voltage and filter the input voltage to output a stabilized direct current (DC) voltage. The first boost circuit 12 is configured to receive the stabilized DC voltage and boost the stabilized DC voltage for output to the LED backlight module. The second boost circuit 13 is configured to receive the stabilized DC voltage and boost the stabilized DC voltage for output to the LED backlight module. The selection control circuit 14 is configured to alternately select one of the first boost circuit 12 and the second boost circuit 13 to power the LED backlight module.

The LED backlight driving circuit 10 of the present disclosure can solve the problems that possibly the duty ratio is increased and the efficiency is reduced (when the boosted voltage is at a high level) when the voltage is boosted by using a single conventional boost circuit. According to the LED backlight driving circuit 10, a first boost circuit 12 and a second boost circuit 13 are disposed to power the LED backlight module alternately, so it is unnecessary to dispose capacitors for outputting stabilized voltages in the first boost circuit 12 and the second boost circuit 13. Therefore, even when the voltage is boosted to a high level (e.g., 400 V), the efficiency of the circuits will not be reduced and the duty ratio will not be increased, so the present disclosure is of great utility.

Figure 3:
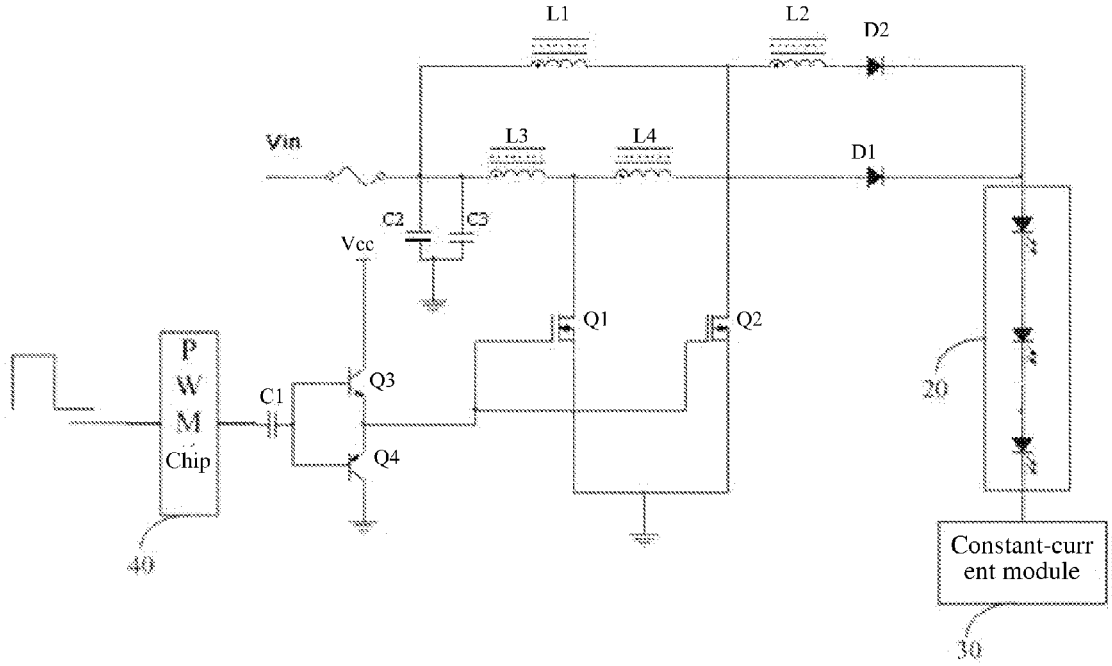
FIG. 3 is a schematic view illustrating a circuit structure of an embodiment of the LED backlight driving circuit according to the present disclosure.

Referring to FIG. 3, in an embodiment, the voltage stabilizing circuit 11 comprises two capacitors C2 and C3, which are connected in parallel with the first boost circuit 12 and the second boost circuit 13 respectively. The two capacitors C2 and C3 are used for supplying a stabilized voltage to the first boost circuit 12 and the second boost circuit 13 respectively. The two capacitors C2 and C3 have one end thereof connected to the first boost circuit 12 and the second boost circuit 13 respectively, and have the other end thereof connected together to the ground.

In an embodiment, the first boost circuit 12 comprises: a first inductor L1, a second inductor L2 and a diode D2 connected in series in sequence, and a metal-oxide-semiconductor field-effect transistor (MOS transistor) Q2 whose drain is connected between the first inductor L1 and the second inductor L2. The MOS transistor Q2 has a gate connected to the selection control circuit and a source connected to the ground; and the MOS transistor Q2 is a P-channel MOS transistor. The second boost circuit 13 comprises: a first inductor L3, a second inductor L4 and a diode D1 connected in series in sequence, and an MOS transistor Q1 whose drain is connected between the first inductor L3 and the second inductor L4. The MOS transistor Q1 has a gate connected to the selection control circuit and a source connected to the ground; and the MOS transistor Q1 is an N-channel MOS transistor. In the present disclosure, having the first boost circuit and the second boost circuit controlled by the selection control circuit 14 to boost a voltage alternately is just equivalent to the case in which two boost circuits supply power alternately in the prior art; and it is unnecessary to dispose capacitors for outputting stabilized voltages in the first boost circuit and the second boost circuit. Therefore, the present disclosure can solve the problem of the decreased voltage boosting efficiency (heat generation) as compared to the case in which a single conventional boost circuit is used, and can reduce the cost (by reducing the number of capacitors, pulse width modulation (PWM) chips 40 and the like) as compared to the case in which a plurality of boost circuits are used in combination.

In an embodiment, the selection control circuit 14 comprises a push-pull circuit, a DC-blocking circuit and a PWM chip 40. The push-pull circuit is connected to the MOS transistor Q1 and the MOS transistor Q2 respectively, and is configured to turn on the MOS transistor Q1 or the MOS transistor Q2. The DC-blocking circuit is connected to the push-pull circuit, and is configured to supply a DC-blocked voltage to the push-pull circuit. The PWM chip 40 is connected to the DC-blocking circuit, and is configured to control the MOS transistor Q1 and the MOS transistor Q2 to turn on alternately, which through the DC-blocking circuit and the push-pull circuit. The PWM chip 40 is further configured to control turn-on time periods of the MOS transistor Q1 and the MOS transistor Q2.

The push-pull circuit comprises two transistors, i.e., a first transistor Q3 and a second transistor Q4. An emitter of the first transistor Q3 is connected with an emitter of the second transistor Q4. A base of the first transistor Q3 is connected in parallel with a base of the second transistor Q4 to the DC-blocking circuit. A collector of the first transistor Q3 is connected to a power source. A collector of the second transistor Q4 is connected to the ground. The first transistor Q3 is of a PNP type, and the second transistor Q4 is of an NPN type. The DC-blocking circuit is a DC-blocking capacitor C1.

Hereinafter, the LED backlight driving circuit 10 will be described in detail with reference to an embodiment thereof. Referring to FIG. 3, the LED backlight driving circuit 10 is connected with an LED backlight module 20 and a constant-current module 30 for making a current of the LED backlight module 20 constant.

The first inductor L1 and the second inductor L2 of the first boost circuit 12 form a set of coupling inductors, and the first inductor L3 and the second inductor L4 of the second boost circuit 13 form another set of coupling inductor. Then by virtue of the turn ratio of the coupling inductors, the output voltage can be boosted.

Meanwhile, the PWM chip (IC) 40 drives the N-channel MOS transistor Q1 and the P-channel MOS transistor Q2 through a DC-blocking capacitor C1 and a push-pull circuit so that the two MOS transistors can be turned on at different time points and the turn-on time periods of the two MOS transistors can be set.

When the PWM chip 40 outputs a high-level voltage, the first transistor Q3 of the push-pull circuit is turned on, and the MOS transistor Q1 of the second boost circuit 13 is turned on to charge the first inductor L3. In this case, the second transistor Q4 of the push-pull circuit is turned off, and the MOS transistor Q2 of the first boost circuit 12 is turned off. Thereby, the first inductor L1 and the second inductor L2 discharge to power the LED backlight module 20.

When the PWM chip 40 outputs a low-level voltage, the second transistor Q4 of the push-pull circuit is turned on, and the MOS transistor Q2 of the first boost circuit 12 is turned on to charge the first inductor L1. In this case, the first transistor Q3 of the push-pull circuit is turned off, and the MOS transistor Q1 of the second boost circuit 13 is turned off. Thereby, the first inductor L3 and the second inductor L4 discharge to power the LED backlight module 20.

The PWM chip 40 can further control the output voltage to be at a constant level by sampling the output voltage, comparing the sampled output voltage with a reference voltage and adjusting turn-on time periods of the first boost circuit 12 and the second boost circuit 13 according to the comparison result; and this is a kind of closed-loop control. The PWM chip comprises a pin for feeding back the output voltage, and the output voltage is divided by a resistor (not shown) and then connected to the pin. The voltage (i.e., the output voltage) of the pin will be compared with the reference voltage inside the PWM chip. If the voltage of the pin is higher than the reference voltage, then the PWM chip decreases the duty ratio (turn-on time period/period) of the output by shortening the turn-on time period so as to reduce the output voltage; otherwise, the PWM chip increases the duty ratio to increase the output voltage. Thus, the output voltage can be controlled at a constant level.

The LED backlight driving circuit 10 delivers a high voltage-boosting ratio by means of the coupling inductors (the first inductor L1 coupled with the second inductor L2, and the first inductor L3 coupled with the second inductor L4); and specifically, the voltage-boosting ratio can be determined according to the turn ratio of the two sets of coupling inductors and the turn-on time periods of the boost circuits. Because the problem of heat generation of the circuit is solved, the LED backlight driving circuit 10 can deliver a high voltage boosting ratio; e.g., when the input voltage is 24 V and the output voltage is 240 V, the voltage boosting ratio is 10.

Because constant-current control is carried out in the LED backlight module 20, there are two ways of arranging LEDs: connecting a majority of the LEDs in series with each other; and connecting a majority of the LEDs in parallel with each other. The way of connecting a majority of the LEDs in series with each other requires a higher output voltage, and the way of connecting a majority of the LEDs in parallel with each other requires more balance ICs. When the voltage is boosted to a high level, a majority of the LEDs can be connected in series with each other in the LED backlight module 20 to reduce the number of LEDs that are connected in parallel so as to reduce the number of the balance ICs. Meanwhile, because constant-current control is carried out in the LED backlight module 20 and voltage differences between different strings of LEDs that are connected in parallel are different, increasing the number of LEDs connected in series can reduce the voltage differences of the LEDs (because the turn-on voltage is of a normal distribution), which is favorable for the optical design.

What described above are only preferred embodiments of the present disclosure but are not intended to limit the scope of the present disclosure. Accordingly, any equivalent structural or process flow modifications that are made on basis of the specification and the attached drawings or any direct or indirect applications in other technical fields shall also fall within the scope of the present disclosure.

The invention claimed is:

1. A light emitting diode (LED) backlight driving circuit for powering an LED backlight module, comprising:

a voltage stabilizing circuit, being configured to receive an input voltage and filter the input voltage to output a stabilized direct current (DC) voltage;

a first boost circuit and a second boost circuit connected with the voltage stabilizing circuit respectively, being configured to receive the stabilized DC voltage and boost the stabilized DC voltage for output to the LED backlight module; and a selection control circuit, being configured to alternately select one of the first boost circuit and the second boost circuit to power the LED backlight module;

wherein the first boost circuit comprises a first inductor L1, a second inductor L2 and a diode D2 connected in series in sequence, and a metal-oxide-semiconductor field-effect transistor (MOS transistor) Q2 whose drain is connected between the first inductor L1 and the second inductor L2, wherein the MOS transistor Q2 has a gate connected to the selection control circuit and a source connected to the ground, and the MOS transistor Q2 is a P-channel MOS transistor; and the second boost circuit comprises a first inductor L3, a second inductor L4 and a diode D1 connected in series in sequence, and an MOS transistor Q1 whose drain is connected between the first inductor L3 and the second inductor L4, wherein the MOS transistor Q1 has a gate connected to the selection control circuit and a source connected to the ground, and the MOS transistor Q1 is an N-channel MOS transistor.

2. The LED backlight driving circuit of claim 1, wherein the selection control circuit comprises a push-pull circuit connected to the MOS transistor Q1 and the MOS transistor Q2 respectively, being configured to turn on the MOS transistor Q1 or the MOS transistor Q2; a DC-blocking circuit connected to the push-pull circuit, being configured to supply a DC-blocked voltage to the push-pull circuit; and a pulse width modulation (PWM) chip connected to the DC-blocking circuit, being configured to control the MOS transistor Q1 and the MOS transistor Q2 to turn on alternately which through the DC-blocking circuit and the push-pull circuit.

3. The LED backlight driving circuit of claim 2, wherein the push-pull circuit comprises a first transistor Q3 and a second transistor Q4, wherein an emitter of the first transistor Q3 is connected with an emitter of the second transistor Q4, a base of the first transistor Q3 is connected in parallel with a base of the second transistor Q4 to the DC-blocking circuit, a collector of the first transistor Q3 is connected to a power source, a collector of the second transistor Q4 is connected to the ground, the first transistor Q3 is of an NPN type.

4. The LED backlight driving circuit of claim 3, wherein the voltage stabilizing circuit comprises two capacitors connected to the first boost circuit and the second boost circuit respectively.

5. The LED backlight driving circuit of claim 2, wherein the DC-blocking circuit is a DC-blocking capacitor C1.

6. The LED backlight driving circuit of claim 2, wherein the PWM chip is further configured to control an output voltage to be at a constant level by sampling the output voltage, comparing the sampled output voltage with a reference voltage and adjusting turn-on time periods of the first boost circuit and the second boost circuit according to the comparison result.

7. The LED backlight driving circuit of claim 2, wherein the voltage stabilizing circuit comprises two capacitors connected to the first boost circuit and the second boost circuit respectively.

8. The LED backlight driving circuit of claim 1, wherein the voltage stabilizing circuit comprises two capacitors connected to the first boost circuit and the second boost circuit respectively.

9. The LED backlight driving circuit of claim 8, wherein the two capacitors have one end thereof connected to the first boost circuit and the second boost circuit respectively, and have the other end thereof connected together to the ground.

10. The LED backlight driving circuit of claim 1, wherein the voltage stabilizing circuit comprises: two capacitors connected to the first boost circuit and the second boost circuit respectively.

11. An LED backlight driving circuit for powering an LED backlight module, comprising a voltage stabilizing circuit, being configured to receiving an input voltage and filter the input voltage to output a stabilized DC voltage; a first boost circuit and a second boost circuit connected with the voltage stabilizing circuit respectively, being configured to receive the stabilized DC voltage and boost the stabilized DC voltage for output to the LED backlight module, wherein the first boost circuit comprises: a first inductor L1, a second inductor L2 and a diode D2 connected in series in sequence, and an MOS transistor Q2 whose drain is connected between the first inductor L1 and the second inductor L2, wherein the MOS transistor Q2 has a gate connected to the selection control circuit and a source connected to the ground, and the MOS transistor Q2 is a P-channel MOS transistor; and the second boost circuit comprises: a first inductor L3, a second inductor L4 and a diode D1 connected in series in sequence, and an MOS transistor Q1 whose drain is connected between the first inductor L3 and the second inductor L4, wherein the MOS transistor Q1 has a gate connected to the selection control circuit and a source connected to the ground, and the MOS transistor Q1 is an N-channel MOS transistor; and a selection control circuit, being configured to alternately select one of the first boost circuit and the second boost circuit to power the LED backlight module and sample an output voltage to adjust turn-on time periods of the first boost circuit and the second boost circuit.

12. The LED backlight driving circuit of claim 11, wherein the selection control circuit comprises a push-pull circuit connected to the MOS transistor Q1 and the MOS transistor Q2 respectively, being configured to turn on the MOS transistor Q1 or the MOS transistor Q2;

a DC-blocking circuit connected to the push-pull circuit, being configured to supply a DC-blocked voltage to the push-pull circuit; and a PWM chip connected to the DC-blocking circuit, being configured to control, through the DC-blocking circuit and the push-pull circuit, the MOS transistor Q1 and the MOS transistor Q2 to turn on alternately;

wherein the PWM chip is further configured to control the output voltage to be at a constant level by sampling the output voltage, comparing the sampled output voltage with a reference voltage and adjusting the turn-on time periods of the first boost circuit and the second boost circuit according to the comparison result.

13. The LED backlight driving circuit of claim 12, wherein the push-pull circuit comprises:

a first transistor Q3 and a second transistor Q4, wherein an emitter of the first transistor Q3 is connected with an emitter of the second transistor Q4, a base of the first transistor Q3 is connected in parallel with a base of the second transistor Q4 to the DC-blocking circuit, a collector of the first transistor Q3 is connected to a power source, a collector of the second transistor Q4 is connected to the ground, the first transistor Q3 is of a PNP type, and the second transistor Q4 is of an NPN type.

14. The LED backlight driving circuit of claim 12, wherein the DC-blocking circuit is a DC-blocking capacitor C1.

15. The LED backlight driving circuit of claim 12, wherein the voltage stabilizing circuit comprises two capacitors connected to the first boost circuit and the second boost circuit respectively.

16. The LED backlight driving circuit of claim 15, wherein the two capacitors have one end thereof connected to the first boost circuit and the second boost circuit respectively, and have the other end thereof connected together to the ground.

* * * * *